United States Patent [19]

Pasic et al.

[11] 4,276,056

[45] Jun. 30, 1981

[54] METHOD OF REMOVING PARTICULATE MATTER FROM PRECIPITATOR PLATE

[75] Inventors: Hajrudin Pasic, Sarajevo, Yugoslavia; George Herrmann, Los Altos, Calif.

[73] Assignee: Electric Power Research Institute, Inc., Palo Alto, Calif.

[21] Appl. No.: 69,903

[22] Filed: Aug. 27, 1979

[51] Int. Cl.[3] ..... B03C 3/76

[52] U.S. Cl. ..... 55/13; 55/112; 165/5; 165/84

[58] Field of Search ..... 55/13, 112, 113, 300, 55/304; 210/388; 209/381; 165/5, 84

[56] References Cited

U.S. PATENT DOCUMENTS

| | | | |
|---|---|---|---|
| 3,109,720 | 11/1963 | Cummings et al. | 55/112 |

FOREIGN PATENT DOCUMENTS

| | | | |
|---|---|---|---|
| 534531 | 9/1931 | Fed. Rep. of Germany | 55/112 |
| 916945 | 7/1954 | Fed. Rep. of Germany | 55/112 |
| 256846 | 4/1964 | Netherlands | 55/112 |

*Primary Examiner*—David L. Lacey

*Attorney, Agent, or Firm*—Flehr, Hohbach, Test

[57] ABSTRACT

An improved method of removing particulate matter from the plates of electrostatic precipitators includes applying tensile loads to the plates thus inducing high frequency stress whereby the particulate matter tends to break and slide down the surfaces of the plates with minimal reintroduction of the particulate matter into the fluid stream.

2 Claims, 3 Drawing Figures

METHOD OF REMOVING PARTICULATE MATTER FROM PRECIPITATOR PLATE

This invention relates generally to electrostatic precipitators and like structures having plates for collecting particulate matter, and more particularly the invention relates to an improved method of cleaning particulate layers from such plates.

An electrostatic precipitator is a device used to remove particles from a fluid such as a gas in which the particles are suspended. The process depends on passing the suspended particles through an electric discharge area where ionization of the gas occurs. The ions produced collide with the suspended particles and confer on them an electric charge. The charged particles then drift toward an electrode plate of opposite polarity and are deposited on the plate where the electric charge is neutralized.

Such electrostatic precipitators are employed in such applications as electric power generation plants to remove dust particles from furnace fumes. The collected layer is then periodicaly removed by striking the ends of the plates with a hammer or the like. During this process the plate is buckled and the deposited layer is broken into small patches and dislodged from the plate. However, a considerable amount of the particulate matter is pushed back into the main gas stream from where it was originally precipitated thus decreasing the efficiency of the precipitators.

An object of the present invention is an improved method of removing particles from a plate such as used in an electrostatic precipitator.

Briefly, the method of cleaning a collecting plate such as employed in an electrostatic precipitator includes applying tensile loads to the plate whereby particulate layers are broken into larger patches and dislodged from the surfaces of the plate with minimum introduction of the particles back into the main gas stream.

The invention and objects and features thereof will be more readily apparent from the following detailed description and appended claims when taken with the drawing.

Because of the importance of using coal fired power generators in view of the increasing cost of petroleum fuel, the importance of removing pollutants such as fly ash from the coal furnace exhaust becomes acutely important. Heretofore the efficiency of electrostatic precipitators in coal fired power plant applications has been too low to satisfy environmental constraints.

Measurements on the dust dislodgement efficiency have been performed at the High Temperature Gas Dynamics Laboratory (HTFL) at Stanford University which demonstrated that the frequencies and peak accelerations of collecting plates are important factors influencing the efficiency in the dust dislodgement mechanism. Studies show that dust layers behave differently at higher frequencies and are broken into larger patches than at low frequencies.

In accordance with the present invention, higher frequency stresses are induced in particulate layers on a precipitator plate by applying tensile loads to the plate. By applying tensile loads rather than compressive loads, such as imparted by hammer blows, higher frequency stresses of lower magnitude are induced in the plate, and the average lateral displacement around which the plate vibrates are much lower thus introducing less particulate matter back into the gas stream. Accordingly, the particulate layer tends to break away and slide along the plate surface rather than being reintroduced into the fluid stream.

Figure 1:
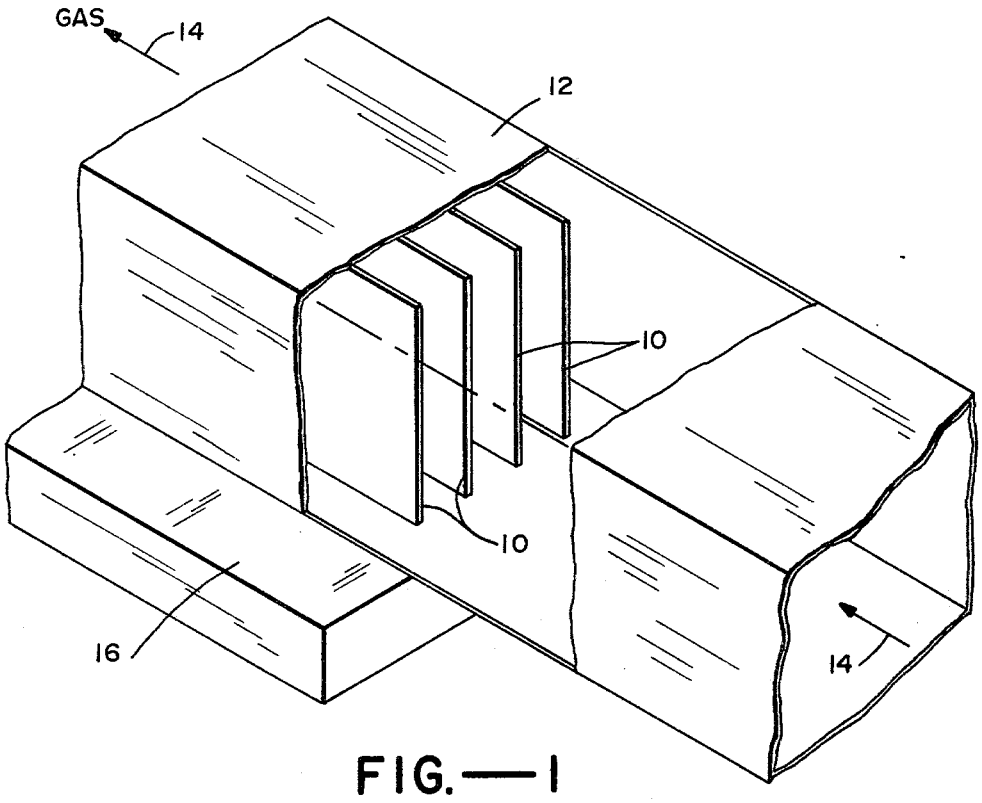
FIG. 1 is a perspective view partially in section of electrostatic precipitator plates in a fluid conduit.

The method is illustrated in the drawings with FIG. 1 showing in perspective view partially in section the placement of electrostatic precipitator plates 10 within a fluid conduit 12 with the plates aligned in the direction of flow of a fluid gas 14. Positioned beneath the electrostatic precipitator plates 10 is a hopper 16 for collecting particulate matter when the precipitator plates are periodically cleaned.

Figure 2:
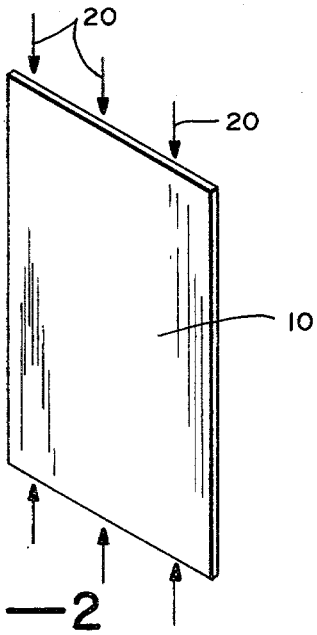
FIG—2 PRIOR ART
FIG. 2 is a diagram illustrating loads applied to a plate for removing particulate matter in accordance with the prior art.

FIG. 2 illustrates the method of cleaning precipitator plates in accordance with the prior art. Typically, compressive loads were imparted to the plates by means of hammer blows or the like. Such forces result in significant lateral displacements around which the plate vibrates and low frequency stresses within the plate and particulate layer. Thus, a considerable amount of the particulate matter is reintroduced into the gas stream.

Figure 3:
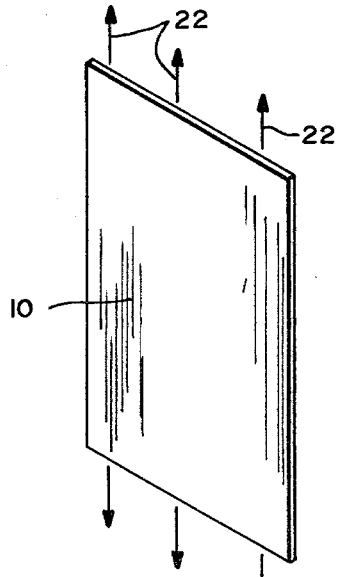
FIG. 3 is a diagram illustrating loads applied to a plate to remove particulate matter in accordance with the present invention.

FIG. 3 illustrates the method of removing particulates from a plate 10 wherein tensile loads 22 are introduced in the plate 10 and the particulate layer thereon. Such loads result in higher frequency stresses and reduced lateral displacements thereby minimizing the amount of particulate matter which is reintroduced into the gas stream. The tensile loads may be readily introduced by pulling the plate. For example, the plate may be supported within a fluid conduit along two opposing edges, and an external mechanism may be connected to one edge for application of the loads. Importantly, the present invention can be readily implemented in existing electrostatic precipitators with minor modifications needed to reverse the direction of loading during a cleaning operation. In new installations a plurality of stiffeners for the plate and support bars may be provided to optimize the plate cleaning for a given magnitude of load. The invention provides increased efficiency of electrostatic precipitators and the like with attendant improvement in environmental impact.

While the invention has been described with reference to a specific embodiment, the description is illustrative of the invention and is not to be construed as limiting the invention. Various modifications and applications may occur to those skilled in the art without departing from the true spirit and scope of the invention as defined by the appended claims.

What is claimed is:

1. A method of removing particles from a plate such as a collecting plate of an electrostatic precipitator comprising the step of applying tensile loads to said plate so as to introduce high frequency stresses in said plate whereby particulate layers are broken into patches and dislodged from the surface of said plate with minimal reintroduction of the particles back into a fluid stream flowing past said plate.

2. The method as defined by claim 1 wherein the step of applying tensile loads to said plate includes applying loads to two opposing edges of said plate.

* * * * *